United States Patent [19]

Weintraub

[11] 4,411,269

[45] Oct. 25, 1983

[54] FRONT OPENING BRA WITH ADJUSTABLE BACK

[75] Inventor: Ronald Weintraub, New York, N.Y.

[73] Assignee: Flexnit Company, Inc., New York, N.Y.

[21] Appl. No.: 299,589

[22] Filed: Sep. 4, 1981

[51] Int. Cl.[3] ..... A41C 3/02; A41C 3/00

[52] U.S. Cl. ..... 128/482; 128/509

[58] Field of Search ..... 128/482, 510, 512, 506, 128/509

[56] References Cited

U.S. PATENT DOCUMENTS

| | | | |
|---|---|---|---|
| 911,204 | 2/1909 | Busby | 128/482 |
| 1,965,997 | 7/1934 | Cochrane-Wilkinson | 128/516 |
| 2,156,478 | 5/1939 | Kemp | 128/509 |

FOREIGN PATENT DOCUMENTS

| | | | |
|---|---|---|---|
| 2058393 | 11/1970 | Fed. Rep. of Germany | 128/482 |
| 907311 | 6/1945 | France | 128/509 |

*Primary Examiner*—Doris L. Troutman

*Attorney, Agent, or Firm*—Lackenbach, Siegel, Marzullo, Presta & Aronson

[57] ABSTRACT

A front opening brassiere having breast cups with a continuously adjustable back strap connecting the side panels of the breast cups, and a pair of adjustable shoulder straps extending from the upper portions of said breast cups and terminating adjacent to the connections of said side panels of the breast cups to the continuously adjustable back strap.

11 Claims, 4 Drawing Figures

FIG. 1
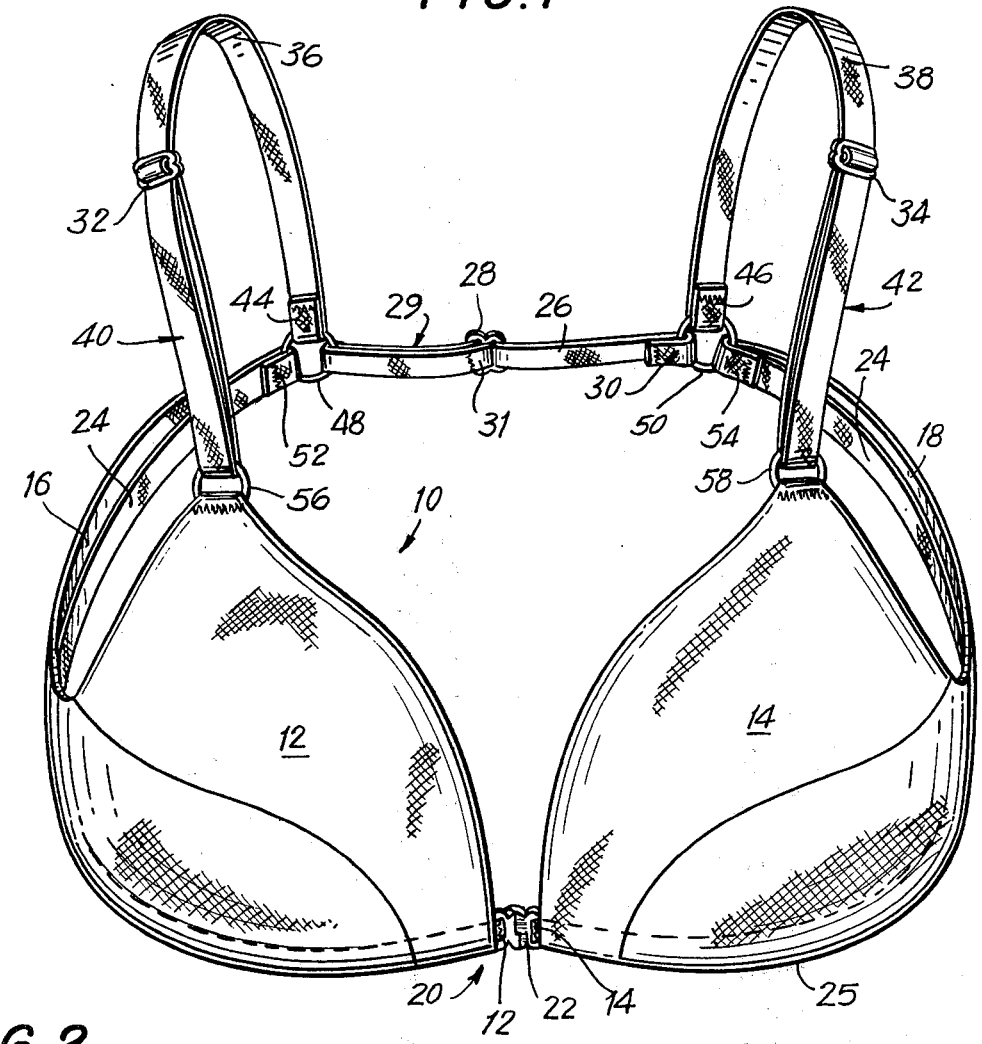
FIG. 2
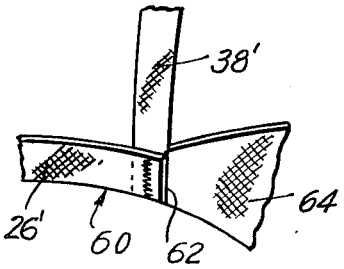
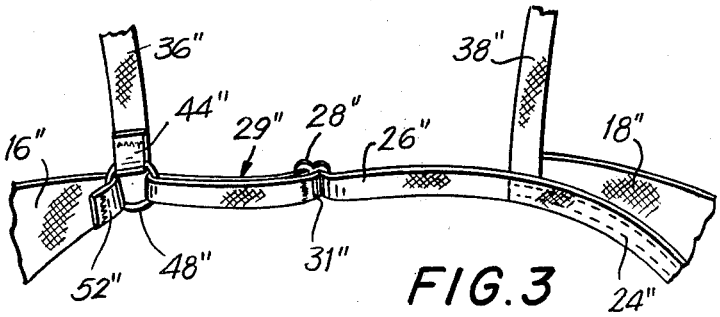
FIG. 3
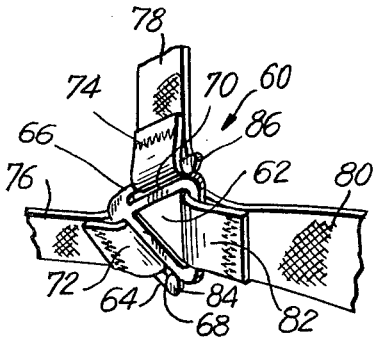
FIG. 4

FRONT OPENING BRA WITH ADJUSTABLE BACK

This invention relates to foundation garments of the brassiere type and to a front opening brassiere, and, more particularly, to a front opening brassiere or bra with continuously adjustable means provided at the back and shoulder straps of the brassiere or bra.

BACKGROUND OF THE INVENTION

Many foundation garments manufactured and sold today incorporate front or rear openings in a bra or brassiere having fixed or adjustable shoulder straps. Other brassieres may even include both front and rear openings with suitable shoulder straps, but none however, provide continuously adjustable back and shoulder straps together with a front closure.

For example, it is known from U.S. Pat. Nos. 2,864,375 and 3,291,132, respectively, to Steinmetz and Puliofico to provide a brassiere with adjustable shoulder straps and a back closure and no front closure.

U.S. Pat. No. 2,455,036 to Boylon, on the other hand, teaches adjustable shoulder straps which connect to the opposite sides of the back or side panels. Thus, no back adjustment is used, as the shoulder straps cross over or through a central "floating" back loop or ring, so that the floating ring is a connection between the shoulder straps or between the shoulder strap and rear band or strap of a brassiere.

Other brassiere patents, such as U.S. Pat. Nos. 2,686,749, 911,204, 2,602,939, 1,670,684 and U.S. Pat. Nos. 204,264 teach other bra structures which incorporate one or more features of the improved front opening brassiere of the present invention. None, however, are believed directed to my invention, which incorporates an improvement in brassiere constructions which is much more convenient in use because of the unique and novel combination of features and since such brassiere structures can be economically manufactured and as they lend themselves to a wide variety of styles.

SUMMARY OF THE INVENTION

In accordance with the present invention, there is provided an improved brassiere comprising a front opening bra with compatible continuously adjustable back and shoulder straps. The back and shoulder straps extend from the ends of the side panels, preferably from mounting means, such as a ring or other adjustment means which enables loops of the straps passing through the rings to be free to move along the ring, thus permitting free movement of one's body without discomfort to the wearer.

The invention will now be described in greater detail, and more particularly in conjunction with the accompanying drawing.

BRIEF DESCRIPTION OF THE DRAWINGS

FIG. 1 is a perspective view of my improved front opening brassiere with continuously adjustable back or rear shoulder straps;

FIG. 2 is a fragmentary view of an alternate means of mounting or securing the continuously adjustable back and shoulder straps to the side panels;

FIG. 3 is a further fragmentary view of my improved front opening brassiere, but illustrating a modification where the continuously adjustable back or rear strap is a continuation of a unidirectional elastic underbust band extending in a substantially continuous manner about the base of the brassiere, and FIG. 4 is another fragmentary view, similar to that of FIG. 2, but showing an alternative modification for both the continuously adjustable back and shoulder straps to the side panels.

DESCRIPTION OF THE PREFERRED EMBODIMENTS

Referring now to the drawing, and in particular to FIG. 1, there is shown my improved front opening brassiere 10, which comprises a pair of bust cups 12 and 14 including side panels 16 and 18. The bust cups 12 and 14 are joined together at 20 with a suitable front closure 22, such as the separable fastener or clasp disclosed in U.S. Pat. Nos. 3,002,464, 3,844,000 and 3,251,110. Any suitable closure may be employed in the practice of the invention provided the closure is substantially small and relatively flat, and is of the type which enables the joining of the bust cups in a desired spaced relationship. The closure should also be of a suitable material, such as plastic or metal, and be capable of repeated use; and it should not deteriorate after numerous hand or machine washings or other cleaning operations utilizing strong detergents and/or caustic chemicals.

The form of the bust cups and side panels may be of unitary construction or formed by a plurality of panels, suitably sewn together at seam lines forming the desired cups and panels. Such features which are concerned with the style of the brassiere do not form part of the invention, as the invention is capable of being adapted to just about any type of brassiere construction. In the preferred embodiment of the invention, it is most advantageous to employ an underbust band 24, about the base 25 of the garment in a substantially continuous manner. Thus, for example, in the brassiere shown in FIG. 1, the band 24 is in three sections, one at the base of each bust cup, each side panel, and the one constituting the continuously adjustable back or rear strap 26. As shown therein, the back or rear strap 26 is provided with a suitable buckle or other type of friction device 28 and an adjustable looped portion 29. The strap 26 is suitably secured by fixed loop means 30 at one end thereof to a side panel and at its other end or adjustable looped portion 29 to the other side panel. The actual distal end 31 of the strap 26 in turn is suitably secured to the center post of the buckle or friction device 28, such as by stitching. With such an arrangement, the size of the back or rear strap 26 can be anywhere from about full length to half-length.

Buckles 32 and 34 are provided on a pair of shoulder straps 36 and 38 thus making them continuously adjustable, like the back or rear strap 26. The buckles 32 and 34 need not be identical to the buckle 28. Other types may be used as long as the shoulder straps 36 and 38 can be continuously adjustable, as in the instance of the back strap 26. Adjustable loop portions 40 and 42 of the shoulder straps 32 and 34 enable the shoulder straps to vary in length from full to half-length. The shoulder straps 36 and 38 comprise fixed loop means 44 and 46 preferably located at the back of the brassiere 10 for suitable securement to the common mounting elements, such as ring means 48 and 50.

As shown in FIG. 1, a preferred embodiment of the invention is where sides of the bra and all straps come together at common elements at the back of the bra, such as the ring means 48 and 50. Other similar mounting elements such as triangles (not shown), which permit complete freedom of movement without any discomfort whatsoever to the wearer may also be used. In the preferred construction of the invention, the underbust band 24 is also provided with fixed loop means 52 and 54 enabling the side panels to be respectively secured to rings 48 and 58.

The adjustable loop portions 40 and 42 of the shoulder straps 36 and 38 are suitably passed through respective ring means 56 and 58 secured to the top of the bust cups 12 and 14. It should also be recognized at this time that the bust cups 12 and 14 may be of any conventional construction, such as ones formed by a plurality of panels of material with the same or different elastic characteristics for forming the shape and size of the cups or the cups may even comprise unitary performed and sized cups of soft material. Regardless of the different shapes and sizes, the combination of the front closure and the continuously adjustable feature of the two shoulder straps and the continuously adjustable back or rear strap enable the brassiere to conform to the principles of the present invention. Endemic to these principles is that the back and shoulder straps meet or join at a common point, such as by means of the rings shown or by means of triangles (not shown). Furthermore, the front ends of the shoulder straps are adjustably secured to the top ends of the bust cups. In this manner, the novel brassiere 10 of the present invention enables a wearer to position the brassiere upon and remove it from the body with great facility, particularly in view of the feature of the front closure, and, with equal ease, adjust the brassiere to the shape of the torso at the area of the female bust. Once the continuously adjustable shoulder and back or rear straps are adjusted to the desires and the needs of a wearer, the brassiere can be donned and removed with minimal if any adjusting of the shoulder and back or rear strap from one wearing to the next.

In the alternate embodiment shown in FIG. 2, the fixed end 60 of the back strap 26' is suitably secured, such as by stitching 82, to the free or rear end of a side panel 64; and the fixed end of a shoulder strap 38' is secured at the same location and in a similar manner. The ends of the straps 26' and 38' may, if desired, overlap each other and may be secured by the same means, such as the stitching 62, but such a construction exhibits less adjustably than the preferred embodiment shown in FIG. 1.

As best shown in FIG. 3, the underbust band 24'', if desired, may continue and extend beyond side panel 18'' and form an integral back band or strip 26''. A like buckle or friction device 28'' enables the back strap 26'' to form an adjustable looped portion 29'' with the distal end 31'' of the center back strap 26'' secured to the center post of the dual opening buckle or friction device 28'' by suitable means, such as stitching. In this arrangement, only a single connecting means or ring 48'' is required and it connects in the form of a common T-like joint the other side panel 16'' with the adjustable looped portion 29'' and the adjustable shoulder strap 36''.

In the modification of FIG. 4, the connecting means or ring like element is in the form of a triangular member 60 with an aperture 62 and a pair of adjacent arms 64 and 66 having respective grooves 68 and 70 for receiving the fixed loop means 72 and 74 of the back strap 76 and shoulder strap 78. The side panel 80 has a fixed loop 82 which is mounted to one side of the triangular member 60. The ends of the arms 64 and 66 are preferably provided with protrusions 84 and 86 for retaining the straps 76 and 78 in place so that they cannot be accidentally removed from or slide off the arms 64 and 66.

The back and shoulder straps are all preferably made of an elastic material which exhibits stretchability in one direction, that is, along the length of the strap. Expressed otherwise, the shoulder straps are longitudinally elastic. The underbust band should also have the same stretch characterstics, and is preferably of the same material as the back and shoulder straps. In this connection, the underbust bands 24 may be suitably connected at their front ends to the apertures in the opposite halves of the front closure 22, as at 12 and 14.

The materials or fabrics used for making the bust cups and side panels may comprise conventional materials well known in the foundation trade and industry, such as cotton, rayon, silk, polyesters, nylon, satin, etc., and such materials may exhibit numerous characteristics, such as stretch along one or more directions, softeness and/or smoothness, transparency, opaqueness, or other particular properties which may be desirable for a specifically styled brassiere.

It will be appreciated that the elastic and continuously adjustable back and shoulder straps together with the elastic underbust band cooperate to maintain the brassiere in place upon the body of the wearer. The average female will take her body or torso through various stages of stress and relaxation during any twenty-four hour period. The body may be completely relaxed. On the other hand, the female may be exercising, walking, raising and lowering her arms, and otherwise proceeding through perfectly normal movements. It is quite conventional in the foundation industry to say that a brassiere "rides up" upon the body. In fact, this has been proven not to be the case. Rather, it is the skin of the body that rides in relationship to the brassiere. It is a basic principle of the present invention to enable a female to adjust the brassiere of the present invention and then to be able to don and remove it without having to adjust it on each such occasion. This result is achieved by the brassiere of the present invention. The front opening and closure acts in cooperation with the continuously adjustable shoulder and back or rear straps. In addition to the fact that these straps are continuously adjustable, they meet at a common point and are joined to one another by means such as rings or triangles that enable these straps to adjust their position with respect to one another by moving in a pivotal-like manner. Accordingly, the body of the wearer can "ride" with respect to the brassiere without the wearer experiencing any discomfort. The brassiere will maintain its proper position relative to the torso, the continuous adjustably of the shoulder and back or rear straps are intended to provide the proper amount of elongation and contraction as the body experiences normal but yet quite different types of movement, and the wearer should experience little if any stress or strain on the body as long as the brassiere is maintained in place. Moreover, and as already pointed out, it should not be necessary to effect very much adjustment from one wearing to the next. However, when adjustment is required, it will be quite easily effected in view of the continuous adjustability of both the shoulder and the back or rear straps.

Although the present invention has been described in some detail by way of illustration and example for purposes of clarity of understanding, it will, of course, be understood that various changes and modifications may be made in the form, details, and arrangements of the parts without departing from the scope of the invention as set forth in the following claims:

What is claimed is:

1. A brassiere comprising a pair of breast cups, a front-opening closure connected to said breast cups, and an adjustable back strap connecting side panels of said bust cups to one another, a pair of adjustable shoulder straps extending from the upper portions of said breast cups and terminating at the back of said brassiere in the general vicinity of the joint connection formed by said adjustable back strap and said side panels; and connection means at at least one of said joints of said adjustable back strap and said side panels with said adjustable shoulder strap comprising a triangular-like element which is coupled to said adjustable back shoulder straps and to said side panel by means of looped sections formed on said side panel and on said adjustable back and shoulder straps; and said triangular-like element is provided with at least a pair of adjacent arms extending from one corner of said triangular-like element with protrusions at the ends of said arms for precluding said looped sections from slipping off said arms.

2. The brassiere according to claim 1, wherein the other of said joint of said adjustable back strap and said side panel with said adjustable shoulder strap comprises stitching of said adjustable back and shoulder straps to the adjacent side panel.

3. The brassiere according to claim 2, wherein said underbust band and said adjustable back strap form a single element of material.

4. The brassiere according to claim 1, wherein said adjustable shoulder straps extend from the upper portions of said breast cups by means of connecting ring-like elements.

5. The brassiere according to claim 1, wherein said back strap is continuously adjustable.

6. The brassiere according to claim 1, wherein said shoulder straps are continuously adjustable.

7. The brassiere according to claim 1, wherein said back and shoulder straps are continuously adjustable.

8. The brassiere according to claim 1, including an underbust band at the base of said brassiere.

9. The brassiere according to claim 1, wherein said underbust band substantially encircles the base of said brassiere.

10. The brassiere according to claim 9, wherein said underbust band and said adjustable back strap are made of the same material.

11. The brassiere according to claim 10, wherein said underbust band and said adjustable back strap are made of a longitudinally stretchable material.

* * * * *